US005826518A

United States Patent [19]

Bhat et al.

[11] Patent Number: 5,826,518

[45] Date of Patent: Oct. 27, 1998

[54] HIGH VELOCITY INTEGRATED FLUE GAS TREATMENT SCRUBBING SYSTEM

[75] Inventors: Pervaje A. Bhat, North Canton; Dennis W. Johnson, Barberton; Robert B. Myers, Norton, all of Ohio

[73] Assignee: The Babcock & Wilcox Company, New Orleans, La.

[21] Appl. No.: 600,707

[22] Filed: Feb. 13, 1996

[51] Int. Cl.[6] ..... F23J 3/00

[52] U.S. Cl. ..... 110/216; 110/215; 55/222

[58] Field of Search ..... 110/215, 216, 110/217; 55/222, 257.2, 257.7; 261/111, 127

[56] References Cited

U.S. PATENT DOCUMENTS

| | | | |
|---|---|---|---|
| 3,447,492 | 6/1969 | Kreimann et al. | 55/222 |
| 3,522,000 | 7/1970 | Kinney | 55/222 |
| 3,800,505 | 4/1974 | Tarves, Jr. | 55/222 |
| 3,839,849 | 10/1974 | Maniya | 55/222 |
| 4,121,541 | 10/1978 | Kneissl et al. | 55/222 |
| 4,194,889 | 3/1980 | Wanner | 55/222 |
| 4,245,569 | 1/1981 | Fallon, III | 110/215 |
| 4,263,021 | 4/1981 | Downs et al. | 55/73 |
| 4,426,210 | 1/1984 | Drawert et al. | 55/222 |
| 4,487,139 | 12/1984 | Warner | 110/345 |

(List continued on next page.)

FOREIGN PATENT DOCUMENTS

| | | | |
|---|---|---|---|
| 1271296 | 6/1968 | Germany | 55/222 |
| 3901081 | 7/1990 | Germany | 55/222 |
| 1069232 | 7/1985 | U.S.S.R. | 55/222 |
| 1315005 | 6/1987 | U.S.S.R. | 55/222 |
| 1418316 | 12/1975 | United Kingdom | 55/222 |

OTHER PUBLICATIONS

Jinjun Sun et al, "A Method to Increase Control Efficiences of Wet Scrubbers For Submicron Particles and Particulate Metals," Air & Waste, Feb. 1994 vol. 44.

"Utility Seeks to Integrate Heat Recovery Flue Gas Treatment", Power, May, 1994.

J.G. Noblett, Jr. et al, "Control of Air Toxics From Coal Fired Power Plants Using FGD Technology", EPRI Symposium on $SO_2$ Control, 1993, Boston.

"Flux•Forcel Condensation Scrubbing System Controls Emissions From Medical Waste Incinerator," The Air Pollution Cons. Nov./Dec. 1993.

The McIlvaine Scrubber Manual, vol. IV, Ch. 2.4 Mist Eliminators, pp. 124, 481–124, 495.

Scrubber Generated Particulate Literature Survey–EPRI Report CS–1739, Mar. 1981.

Entrainment Separators For Scrubbers–Seymour Calvert et al. EPA Report 650/2–74–119a Oct. 1974.

P.A. Bhat et al. "Results of Particulate and Gaseous Sampling from a Wet Scrubber Pilot Plant" presented EPRI Syn Apr. 5–8.

Babeck & Wilcox White Paper On Condensing Heat Exchangers–admitted prior art.

U.S. application Ser. No. 08/445,810 filed May 22, 1995.

*Primary Examiner*—Henry A. Bennett
*Assistant Examiner*—Jiping Lu
*Attorney, Agent, or Firm*—Daniel S. Kalka; Robert J. Edwards

[57] ABSTRACT

An integrated flue gas treatment desulfurization system for treating flue gas exhausted from an electrostatic precipitator and passing at a flue gas flow velocity in the range of 10–20 ft./sec. or more through a condensing heat exchanger and a wet flue gas scrubber. The scrubber sprays a reagent throughto the flue gas effectively remove pollutants and metals prior to exhausting same in a dry form after treatment by mist eliminators located downstream of the system.

6 Claims, 5 Drawing Sheets

U.S. PATENT DOCUMENTS

| | | | |
|---|---|---|---|
| 4,509,437 | 4/1985 | Breidenback et al. | 110/215 |
| 4,557,202 | 12/1985 | Warner | 110/216 |
| 4,705,101 | 11/1987 | Warner | 165/104.31 |
| 4,799,941 | 1/1989 | Westmark | 55/222 |
| 4,999,167 | 3/1991 | Skelely et al. | 55/222 |
| 5,080,696 | 1/1992 | Marchand et al. | 55/222 |
| 5,176,723 | 1/1993 | Liu et al. | 55/222 |
| 5,217,508 | 6/1993 | Jonsson | 55/222 |
| 5,246,471 | 9/1993 | Bhat et al. | 55/223 |
| 5,282,429 | 2/1994 | Kato et al. | 110/215 |
| 5,345,884 | 9/1994 | Vandycke et al. | 110/216 |
| 5,368,096 | 11/1994 | Williams | 165/113 |
| 5,480,619 | 1/1996 | Johnson et al. | 422/168 |
| 5,510,087 | 4/1996 | Johnson et al. | 422/173 |

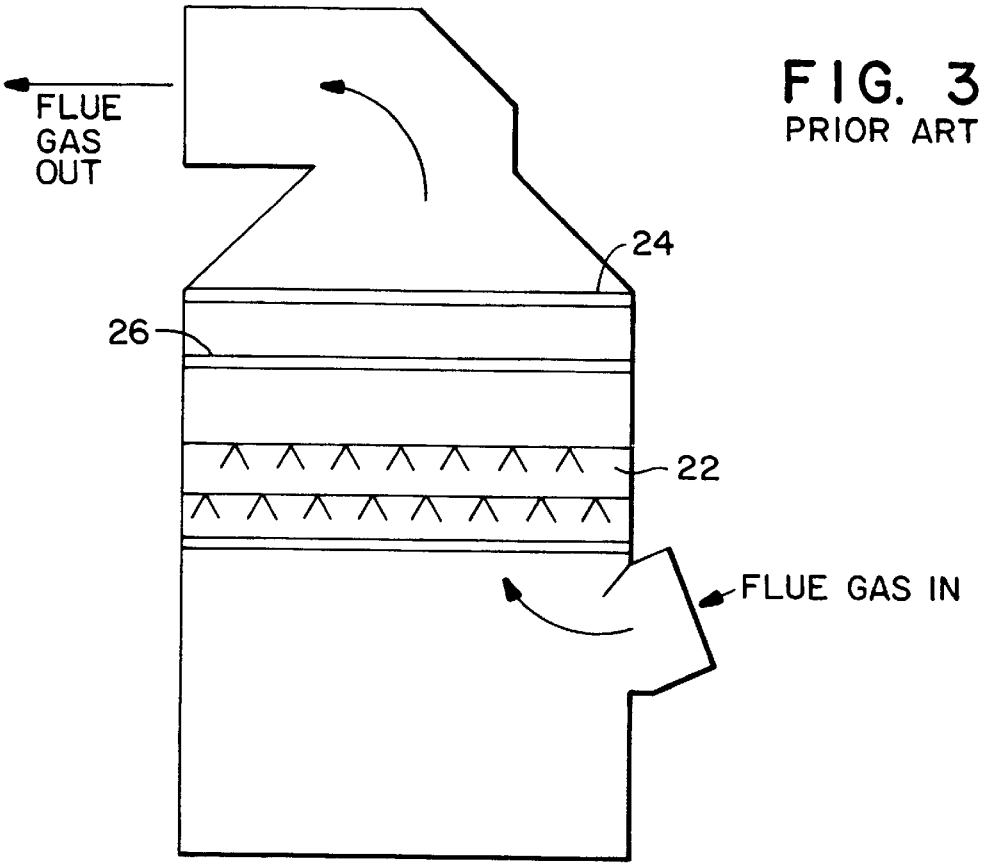
FIG. 3
PRIOR ART
FIG. 4
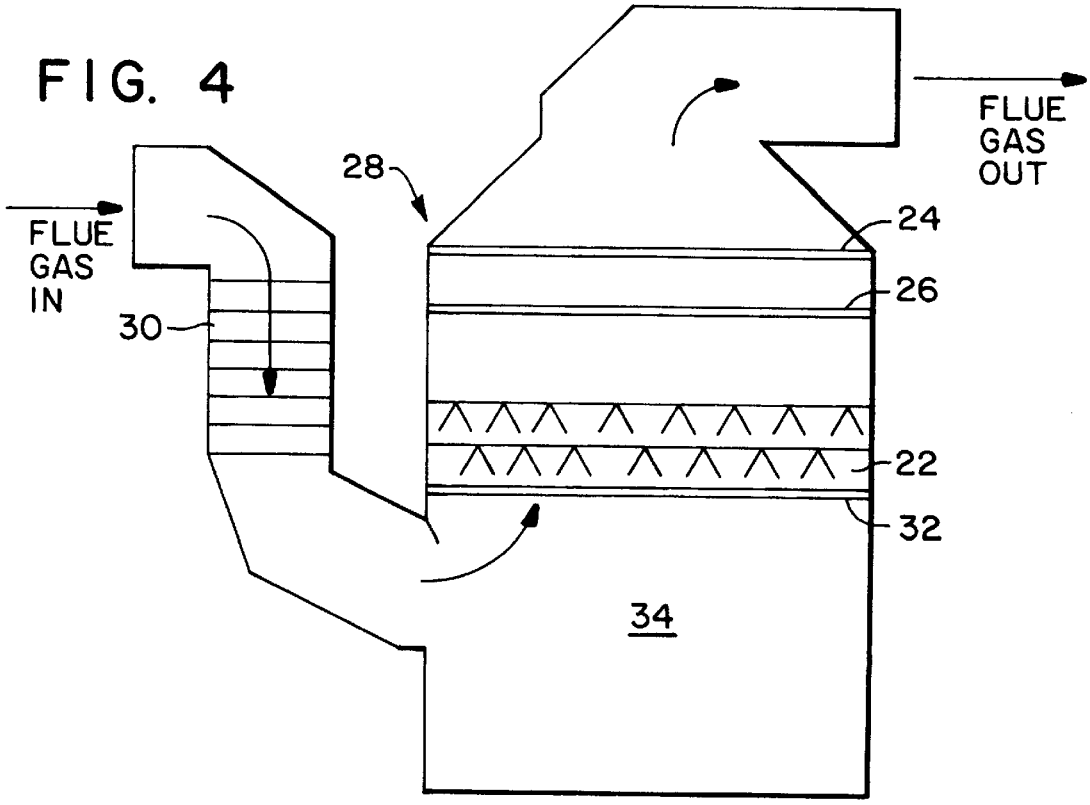

HIGH VELOCITY INTEGRATED FLUE GAS TREATMENT SCRUBBING SYSTEM

BACKGROUND OF THE INVENTION

1. Field of the Invention

The present invention relates to flue gas heat recovery systems in general and more particularly to a combined system of flue gas heat recovery and pollutant removal utilizing a condensing heat exchanger in combination with a wet flue gas desulfurization system.

2. Description of the Related Art

Condensing heat exchangers such as the one shown in FIG. 1, recover both sensible and latent heat from the flue gas as well as removing pollutants such as fly ash, $SO_2$ etc. all in a single unit. The arrangement provides for the flue gas to pass down through heat exchanger modules while the water passes upward in a serpentine path through the tubes. Condensation occurs within the heat exchanger modules as the gas temperature at the tube surface is brought below the flue gas dew point temperature and is exhausted at the bottom. Gas cleaning occurs within the heat exchanger as the flue gas particulate impact the tubes and flows through the falling drops of condensate.

The heat exchanger tubes and inside surfaces of the heat exchanger are made of corrosion resistant material or are covered with Teflon® to protect them from corrosion when the flue gas temperature is brought below the acid dew point. Interconnections between the heat exchanger tubes are made outside the tube sheet and are not exposed to the corrosive flue gas stream.

Since the condensate flows downward in the direction of the flow of the flue gas, gas to water contact is not maximized. Also, there is no provision for external spray of reagents to eliminate non-particulate pollutants such as HCl, HF, $SO_2$, $SO_3$ and $NO_x$. As such the system is relatively limited in cleaning ability and is relatively inefficient.

The Integrated Flue Gas Treatment (IFGT™) condensing heat exchanger, shown schematically in FIG. 2, is a condensing heat exchanger designed to enhance the removal of both gaseous pollutants and particulate matter from the flue gas stream. It is made of corrosion resistant material or has all of the inside surface covered with Teflon®.

There are four major sections of the IFGT™ system; the first heat exchanger stage (10), the interstage transition region (12), the second heat exchanger stage (14), and the mist eliminator (16). The major differences between the integrated flue gas treatment design and the condensing heat exchanger design of FIG. 1 are:

1.) the integrated flue gas treatment design uses two heat exchanger stages instead of one.

2.) the interstage transition region, located between the two heat exchanger stages, is used to direct the gas to the second heat exchanger stage and acts as a collection tank and allows treatment of the gas between the stages, 3.) the gas flow in the second heat exchanger stage is upward, rather than downward, 4.) the gas outlet of the second heat exchanger stage is equipped with an alkali reagent spray system, and 5.) a mist eliminator is used to separate the carryover formed by the reagent sprays and condensation from the flue gas.

Most of the sensible heat is removed from the gas in the first heat exchanger stage (10) of the IFGT™ system. The transition region (12) can be equipped with a water or alkali spray system (18). This system saturates the flue gas with moisture before it enters the second heat exchanger stage (14) and also assists in removing sulfur and halogen based pollutants from the gas. The transition piece is made of corrosion resistant fiberglass-reinforced plastic. The second heat exchanger stage (14) is operated in the condensing mode, removing latent heat from the gas along with pollutants. The top of the second heat exchanger stage (14) is equipped with an alkali solution spray system (20). The gas in this stage is flowing upward while the droplets in the gas fall downward. This counter current gas/droplet flow provides a scrubbing mechanism that enhances particulate and gas pollutant removal, and the reacted reagent alkali solution is collected at the bottom of the transition section. The flue gas outlet of the IFGT is also equipped with the mist eliminator (16) to reduce the chance of moisture carryover into the exhaust.

The design, while an improvement over the FIG. 1 system, does not offer a single heat exchanger integrated system where pollutants are removed in a counter-current flow of the flue gas to reagent flow across the entire heat exchanger to maximize contact time. Only the second stage utilizes such flow making the system expensive and relatively inefficient.

Prior art also includes wet chemical absorption processes (i.e. wet scrubbers 22 such as shown in FIG. 3), and in particular those applications wherein a hot gas is typically washed in an up flow gas-liquid contact device such as a spray tower with an aqueous alkaline solution or slurry to remove sulfur oxides and/or other contaminants.

Wet chemical absorption systems installed by electric power generating plants typically utilize calcium, magnesium or sodium based process chemistries, with or without the use of additives, for flue gas desulfurization.

In addition, prior art for wet scrubbing is described in a number of patents such as U.S. Pat. No. 4,263,021, assigned to the Babcock & Wilcox Company issued on Apr. 21, 1981 entitled "Gas-Liquid Contact System" which relates to a method for obtaining counter-current gas-liquid contact between a flue gas containing sulfur dioxide and a aqueous slurry solution. This system is currently referred to as a tray or gas distribution device. In addition, Babcock & Wilcox has retrofitted trays into wet FGD spray towers for the purpose of improving the scrubber performance.

Other wet scrubbers utilize various types of packing inside the spray tower to improve gas-liquid distribution which works well with clear solution chemistry processes, but are prone to gas channeling and pluggage in slurry services.

Most wet scrubbers use mist eliminators (24, 26) normally 2–3 stages to remove entrained water droplets fro the scrubbed gas.

SUMMARY OF THE INVENTION

The present invention is directed to solving the problems associated with prior art systems as well as others by providing a combined flue gas heat recovery and pollutant removal system using a condensing heat exchanger in combination with a wet flue gas desulfurization system to provide an improved method to further enhance the removal of particulate, sulfur oxides and other contaminants including air toxics from a flue gas stream produced by the combustion of waste materials, coal, oil and other fossil fuels which are burned by power generating plants, process steam production plants, waste-to-energy plants and other industrial processes.

To accomplish same, one or more tubular condensing heat exchanger stages are installed upstream (with respect to gas flow) of the absorption zone sprays of a high velocity wet scrubber and downstream of an electrostatic precipitator. Saturated flue gas velocities through the wet scrubber may fall within the range of 10 ft/sec to 20 ft/sec or more and are considered high velocities compared to the normal velocites encountered in prior art devices. A final stage mist eliminator device may also be installed downstream of the absorber. In addition, one or more stages of perforated plates (trays) are provided upon which the liquid is sprayed to further promote gas-liquid contact and eliminate pollutants.

In view of the foregoing it will be seen that one aspect of the present invention is to provide a high velocity flue gas flow through a condensing heat exchanger for conditioning the flue gas prior to wet scrubbing same.

Another aspect of the present invention is to provide a compact high velocity flue gas treatment system using a condensing heat exchanger and a wet flue gas scrubber.

Yet another aspect of the present invention is to provide a flue gas condensing heat exchanger to treat the flue gas prior to wet scrubbing to increase removal of air toxics such as heavy metal particles by the wet scrubber.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a schematic of a prior art wet flue gas treatment system;

FIG. 4 is a schematic of the combined condensing heat exchanger and high velocity wet scrubber of the present invention;

DESCRIPTION OF THE PREFERRED EMBODIMENT

Figure 1:
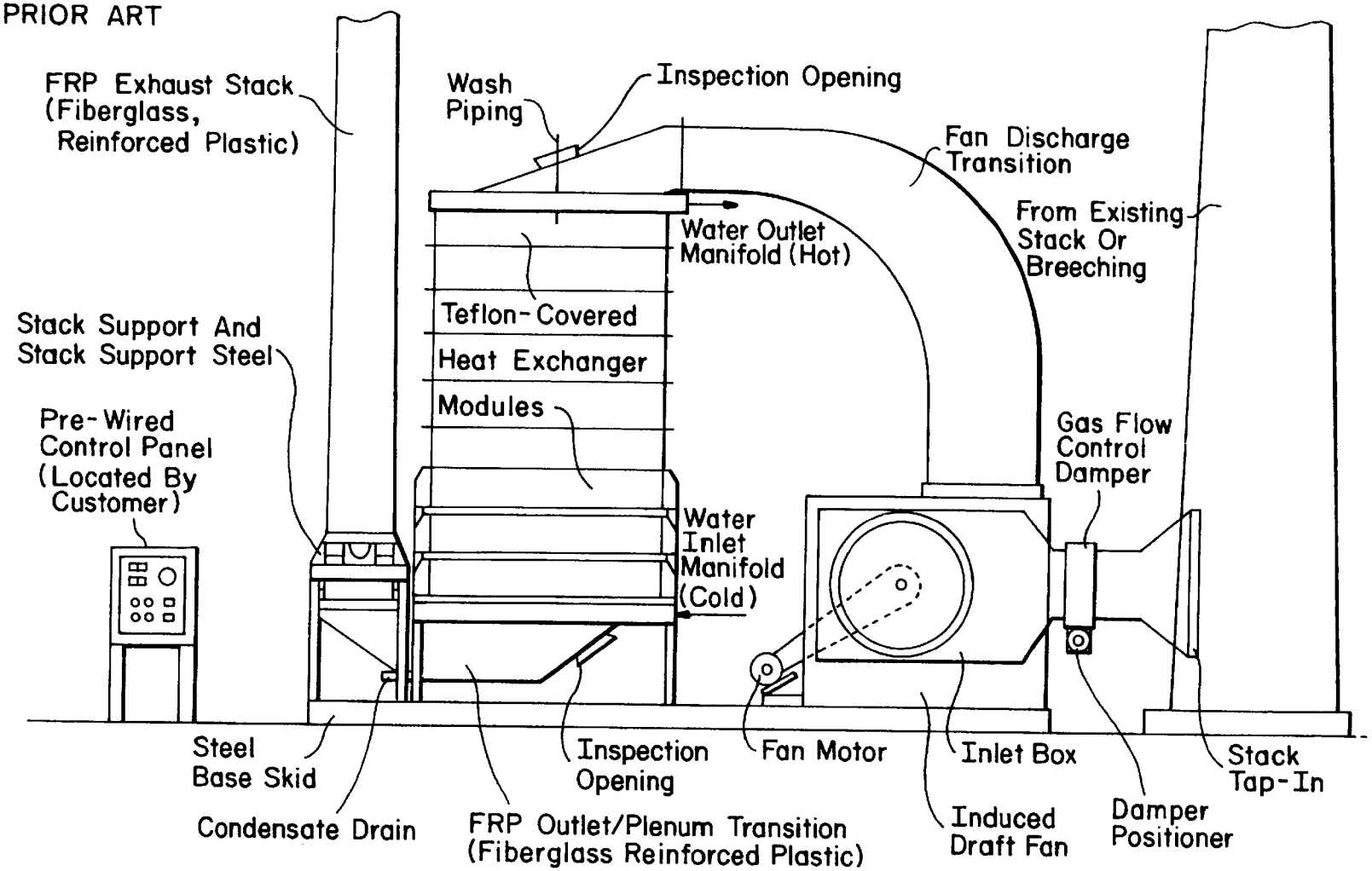
FIG. 1 PRIOR ART
FIG. 1 is a schematic drawing of a downflow condensing heat exchanger.
Figure 2:
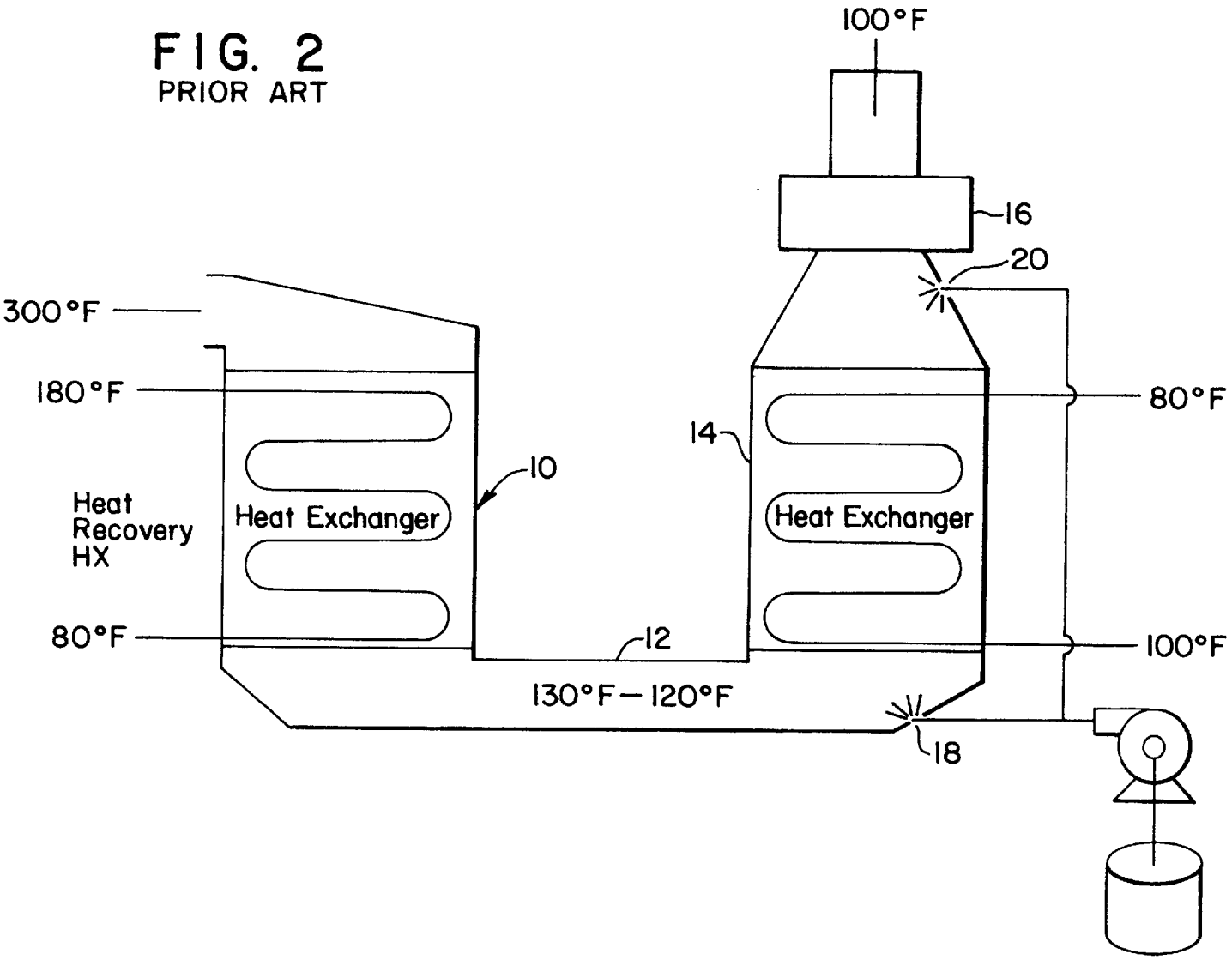
FIG. 2 PRIOR ART
FIG. 2 is a schematic of an integrated flue treatment (IFGT) system having two separate heat exchanger stages.

The present invention as best seen in FIG. 4 discloses a flue gas treatment system (28) which provides an improved high velocity flue gas treatment (FGT) system which further enhances the removal of particulates, sulfur oxides and other contaminants including air toxics from a flue gas stream produced by the combustion of waste materials, coal, oil and other fossil fuels which are burned by power generating plants, process steam production plants, waste-to-energy plants and other industrial processes.

The system comprises a tubular condensing heat exchanger (30) of one or more stages installed upstream with respect to flue gas flow of the absorption zone sprays (22) of the high velocity wet scrubber system (28). Saturated flue gas velocities through the wet scrubber (28) may fall within the range of 10 ft/sec to 20 ft/sec or more. A final stage mist eliminator device (24, 26) is installed downstream of the absorber. In addition, one or more stages of perforated plates (trays) (32) of known design are provided upon which the liquid is sprayed from the spray zone (22) to further promote gas-liquid contact.

Flue gas containing water vapor, particulate (fly ash), sulfur oxides/acid gases, and other contaminants including air toxics in vaporous, liquid and solid forms, enters the condensing heat exchanger (30) where heat is recovered from the flue gas by heating a fluid (i.e. a gas such as air or a liquid such as water). The fluid is at a low enough temperature to promote condensation of gases, with the major condensed gas being water vapor. The cooled flue gas then proceeds to a wet scrubber area (34) and is in counter-current contact with a liquid solution or slurry which is introduced near the top by the known spray system (22) and discharged from the bottom of the wet scrubber (34). The indirect cooling of the flue gas as it comes in contact with the heat exchanger and later, the liquid sprays, results in the condensation of acid gases (such as sulfur trioxide) and other contaminants including vaporous air toxics. As acid gases and other contaminants including vaporous air toxics condense on the tube (30) surfaces, they are removed from the gas stream along with the condensed water. Acid gases and other air toxics are further removed in the wet scrubber (34).

Figure 5:
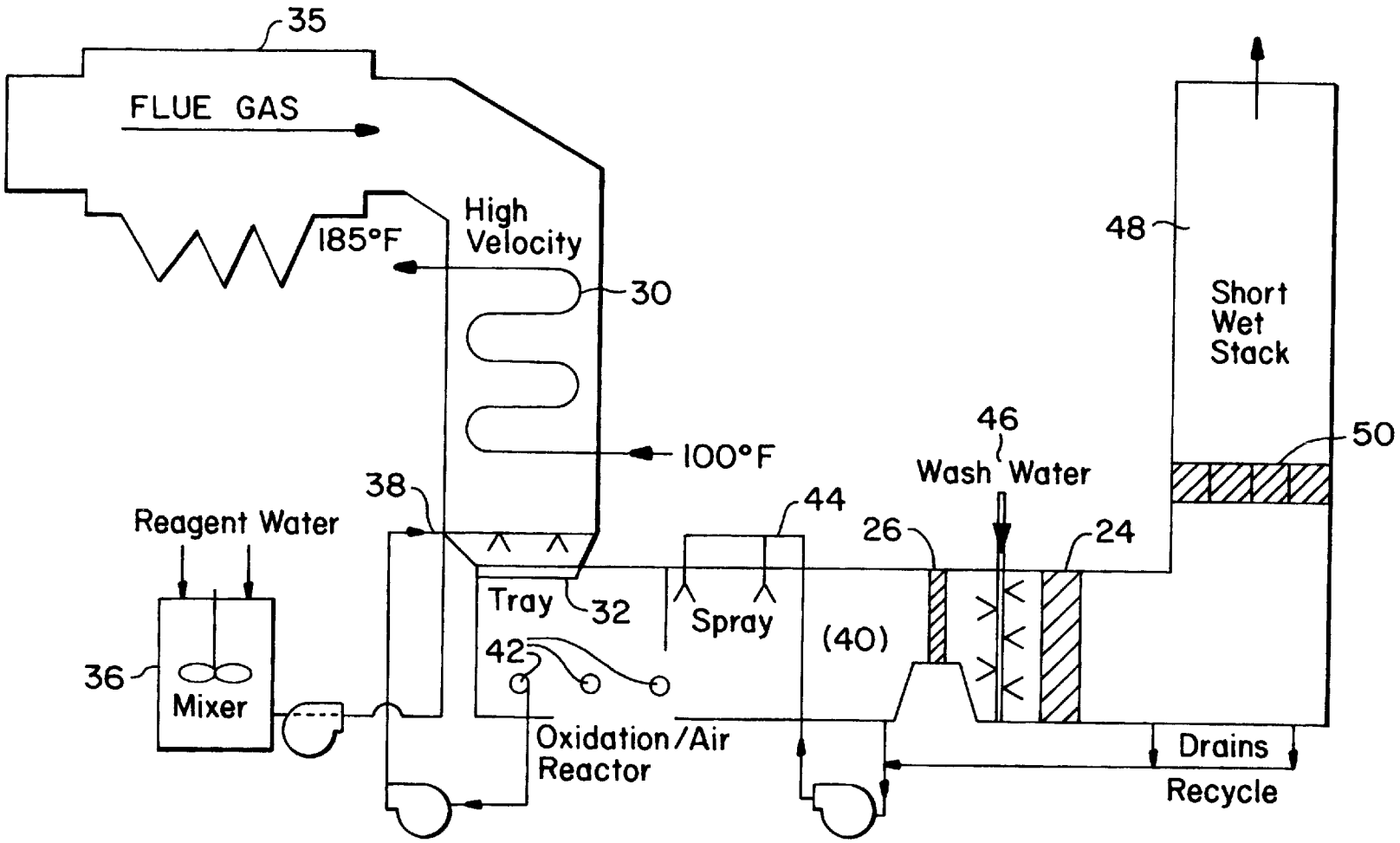
FIG. 5 is a schematic of an alternate embodiment of the FIG. 4 system using flue gas from an electrostatic precipitator cross-current flow in of gas and liquid.
Figure 6:
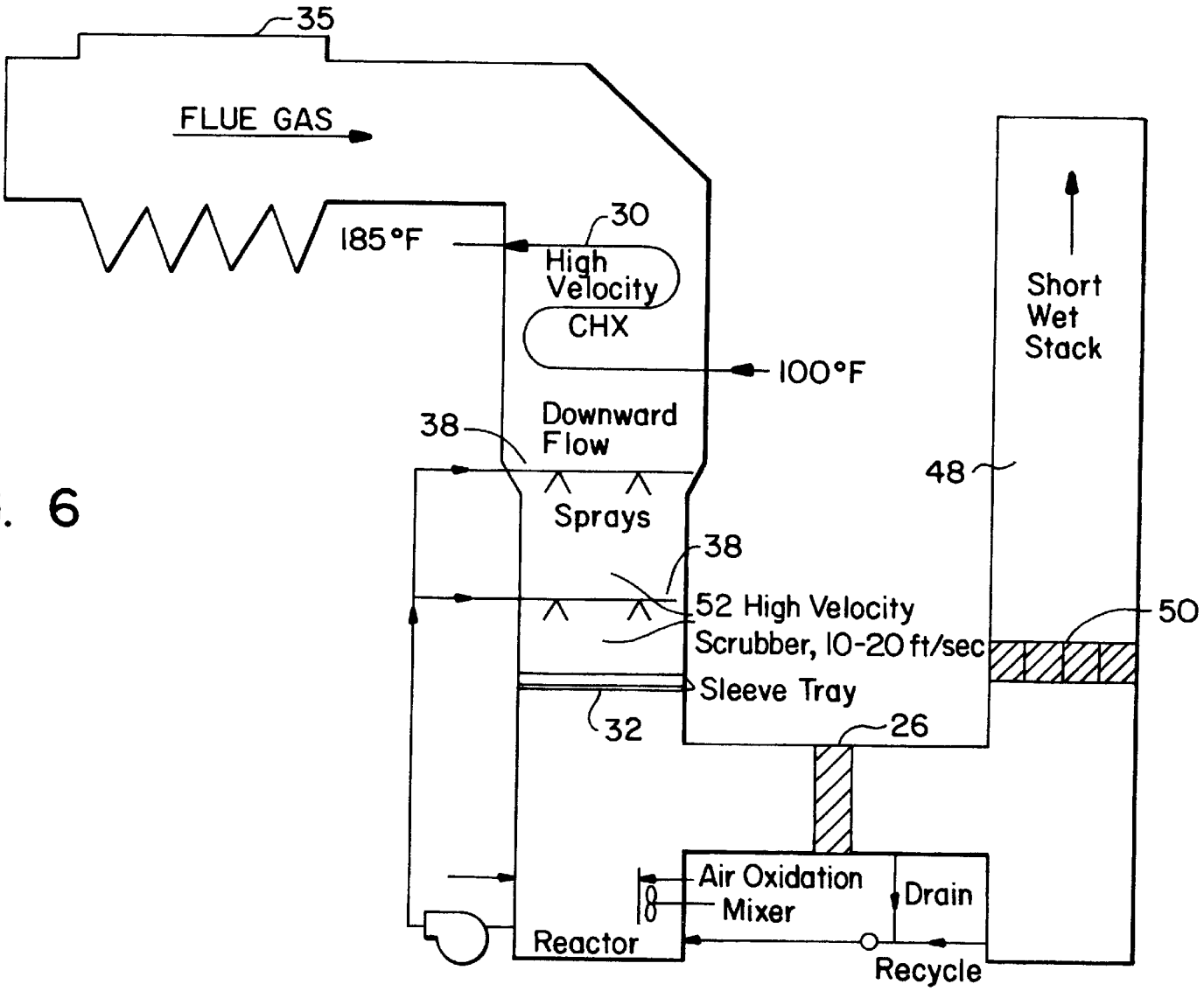
FIG. 6 is a schematic of an alternate FIG. 5 embodiment.

The described system (28) thus offers the following advantages over the known prior art systems:

1. The high velocity scrubbing system reduces the equipment size resulting in considerable capital cost savings.
2. The condensing heat exchanger reduces both the latent heat and sensible heat content of the flue gas and reduces the scrubber makeup water requirements.
3. Lowering the scrubber inlet temperature reduces the partial pressure of the gaseous pollutant components by increased solubility and condensing effects. This enhances the removal of air toxics from the flue gases including mercury and condensed fine heavy metal particulate (selenium, lead, chromium, etc.) which are considered toxic.
4. Short stacks can be used to disperse the flue gas which is virtually free from gaseous pollutants.
5. Mist eliminators placed at the inlet to the stack along with drain collection devices remove entrained moisture and recover it for reuse purposes.
6. The condensing heat exchanger conditions the flue gas prior to scrubbing while simultaneously lowering the gas volume and reducing the problems associated with the wet dry interface i.e., the location at the wet scrubbers entrance where the hot gas first comes in contact with the scrubbing liquid.
7. Pollutant removal is increased in the scrubber due to the increase in the mass transfer coefficient which is a direct result of operation at higher gas velocities. Gas liquid contact through the absorption zone sprays may also be cross-current as is shown in FIGS. 5 and 6. Flue gas enters the heat exchanger in a downward direction from an electrostatic precipitator 35. Condensation of water vapor and air toxics occurs within the higher velocity heat exchanger (30) as the gas temperature at the tube surface is brought below the dew point. As the condensate falls as a constant rain over the tube array which is covered with Teflon or an inert coating, some gas cleaning as described above occurs, further enhancing the collection of air toxics, particulate, and residual sulfur oxides/acid gases through the mechanisms of absorption, condensation, diffusion, impaction, and interception in the integral apparatus. The liquid in the exchanger (30) enters at a temperature of approximately 100° F. more or less and is heated by condensate to about 185° F. at the exhaust. The air toxics components referred to here are mainly volatile organic compounds (VOC), HCl, $SO_3$, HF, heavy metal compounds including oxides, chlorides and/or sulfates of Al, As, Ca, Cd, Cu, Co, Mg, Na, Pb, Fe, K, Zn, Be, V, Hg, Se and organic compounds including hydrocarbons (Chlorinated dibenzo -p- dioxins (CDD), chlorinated dibenzo-furans (CDF), polycyclic aromatic hydrocarbons (PAH), polychlorinated biphenols (PCB), etc.). Most of these air toxics and organic compounds are generated from municipal solid waste (MSW) or fossil fuel fired combustion processes.

The condensate from the condensing heat exchanger along with reagent water from a mixing tank (36) sprayed through a series of nozzles (38) land on the tray (32) through which the lowered temperature flue gas passes and enters a horizontal cleaning chamber (40) having oxidation air holes (42). This chamber has a second series of spray nozzles (44) located upstream of the mist eliminators (24, 26). A series of spray wash water nozzles (46) are located therebetween. The cleaned flue gas enters a short wet stack exhaust (48) which is preceded by final mist eliminator 50.

The FIG. 6 embodiment is similar to FIG. 5 except that the horizontal run chamber (40) is made into a vertical run chamber (52). Both of the FIG. 5 and FIG. 6 embodiments provide easy access and maintenance of the various mentioned components. Also, the additional mist eliminators found therein reduce entrainment and thus no reheat is required.

Certain modifications and improvements have been deleted herein for the sake of conciseness and readability but are intended to be within the scope of the following claims. As an example, the short stack could be fitted with a booster fan that is physically smaller in volumetric capacity (i.e. size/cost) to include draft pressure in lieu a larger more costly forced draft fan. Also, a horizontal flow (horizontal tubes) condensing heat changer unit could be employed for the horizontal FIG. 5 embodiment.

We claim:

1. A flue gas heat recovery and pollutant removal system, comprising:

an electrostatic precipitator situated to receive a high velocity flue gas flow and remove particulate therefrom;

a condensing heat exchanger assembly located to have high velocity flue gas flow downward therethrough, said condensing heat exchanger assembly being located downstream from said electrostatic precipitator and connected thereto, said condensing heat exchanger assembly lowering a temperature of the high velocity flue gas to below its dew point;

a plurality of nozzles for spraying reagent and water into the high velocity flue gas, said nozzles being situated below said condensing heat exchanger assembly;

a sieve tray positioned beneath said nozzles for receiving spray therefrom and condensate from said condensing heat exchanger assembly;

a horizontal cleaning chamber located downstream from said tray, said horizontal cleaning chamber having a second series of spray nozzles for spraying liquid reagent into the high velocity flue gas to remove pollutants therefrom, said horizontal cleaning chamber further having a plurality of oxidation air holes therein, said horizontal cleaning chamber further including spray wash water nozzles located downstream from said second series of spray nozzles;

at least one mist eliminator located in said horizontal cleaning chamber downstream of said second series of spray nozzles to remove any liquid droplets in the flue gas; and a short wet stack exhaust connected to said horizontal cleaning chamber for exhausting the treated flue gas.

2. A system as set forth in claim 1, wherein said condensing heat exchanger assembly water inlet is at the bottom thereof and outlets same at the top thereof to provide counter current flow of heat exchanger assembly liquid to the flow of flue gas therethrough.

3. A system as set forth in claim 1, wherein said second series of spray nozzles sprays an alkaline liquid reagent into the flue gas passing therethrough.

4. A system as set forth in claim 1, further comprising a reagent tank connected to said plurality of nozzles to pump reagent therethrough.

5. A system as set forth in claim 1, further including a final mist eliminator stage located in said short wet stack to catch any water droplets in the flue gas.

6. A system as set forth in claim 1, wherein said spray wash water nozzles are positioned between a first and a second mist eliminator in said horizontal cleaning chamber.

* * * * *